United States Patent [19]

Hopkins

[11] Patent Number: 5,042,367

[45] Date of Patent: Aug. 27, 1991

[54] REVOLVING AIR LOCK

[76] Inventor: Dwight Hopkins, 28555 State Rd. 54 West, Wesley Chapel, Fla. 33543

[21] Appl. No.: 576,267

[22] Filed: Aug. 31, 1990

[51] Int. Cl.[5] ..... E06B 7/02

[52] U.S. Cl. ..... 98/87; 98/115.1

[58] Field of Search ..... 98/87, 1, 42.02, 42.06, 98/115.1, 36; 34/242

[56] References Cited

U.S. PATENT DOCUMENTS

| | | | |
|---|---|---|---|
| 3,115,818 | 12/1963 | Smith | 34/242 |
| 3,166,385 | 1/1965 | Pahlavouni | 34/242 |
| 3,687,053 | 8/1972 | Henson et al. | 98/33 |
| 3,766,844 | 10/1973 | Donnelly et al. | 98/33 R |
| 3,828,490 | 8/1974 | Duquette | 52/2 |
| 4,179,043 | 12/1979 | Fischer | 34/242 |
| 4,375,735 | 3/1983 | Rhoads | 49/68 |
| 4,581,986 | 4/1986 | Conklin et al. | 98/1 |
| 4,598,495 | 7/1986 | Labarile | 49/41 |

OTHER PUBLICATIONS

"Unit Heater Over Revolving Door Solves Entrance Heating Problem", by John G. Eadie, *Heating Piping and Air Conditioning*, May 1940.

*Primary Examiner*—Albert J. Makay
*Assistant Examiner*—William C. Doerrler
*Attorney, Agent, or Firm*—Pettis & McDonald

[57] ABSTRACT

A revolving air lock controls the flow of air, and the passage of contaminants that may be entrained in the air, between two separate areas. The air lock comprises a base, a vertical shaft rotatably connected to the base at one end, and a bearing support apparatus to which the other end of the shaft is rotatably connected. At least two arcuate walls, having an axis generally coaxial with the axis of the shaft, are located generally concentric to and spaced apart from the shaft. The walls are configured to define at least two segments whereby entrance and exit to the air lock may be obtained. Each wall is connected to the bearing support apparatus and to the base with at least one of the walls having at least one aperture therethrough. A panel assembly comprises a plurality of panels with the inner edge of each panel connected to the shaft, such that each panel extends generally radially outwardly therefrom. A panel top edge engaging structure engages the top edges of the panels, providing a top end which closes that end of the air lock. Upon rotation of the shaft the outer edges of each pair of adjacent panels will be moved in a position adjacent to one wall to define the walls of a chamber. The top of the chamber is closed by the top end, and the bottom of the chamber is closed by a slidable engagement between the panel bottom edges and the base. An air mover, connected in air flow communication to the aperture, removes from the chamber a portion of the air particles entrained when that chamber includes that portion of the wall containing an aperture.

18 Claims, 2 Drawing Sheets

Fig. 2A
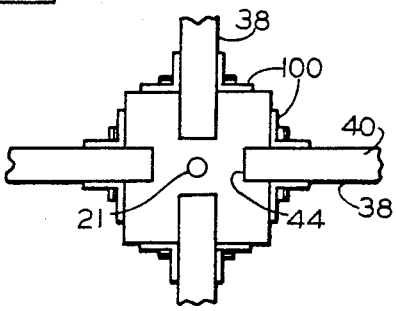
Fig. 3A
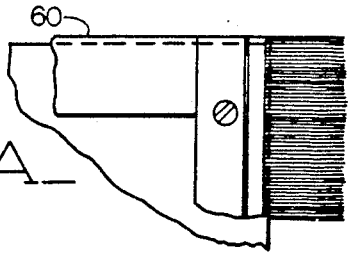
Fig. 3
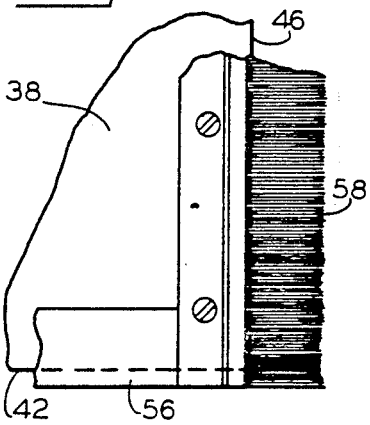
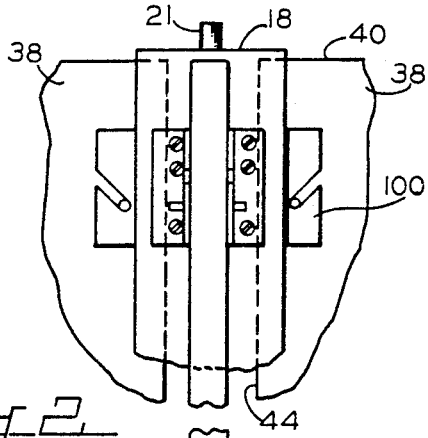
Fig. 2
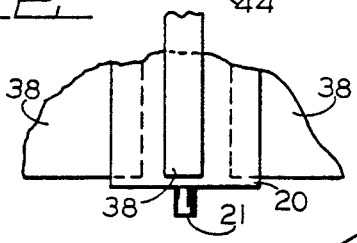
Fig. 4
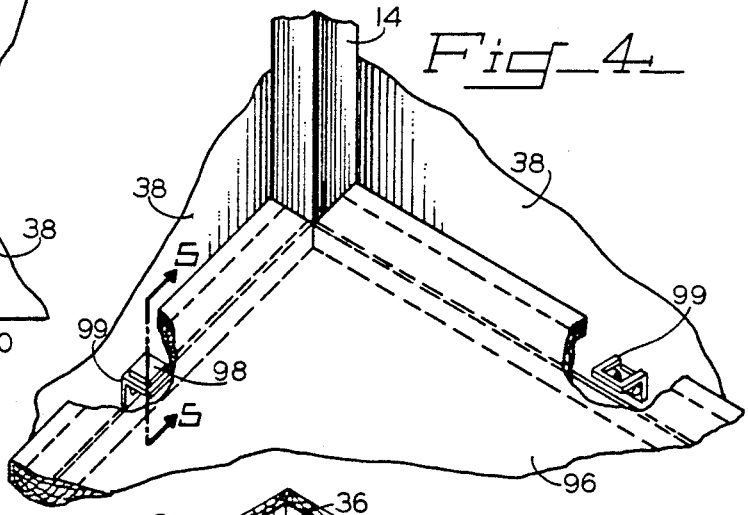
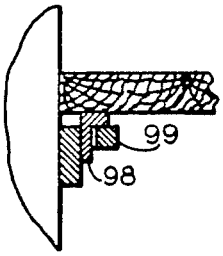
Fig. 5
Fig. 6
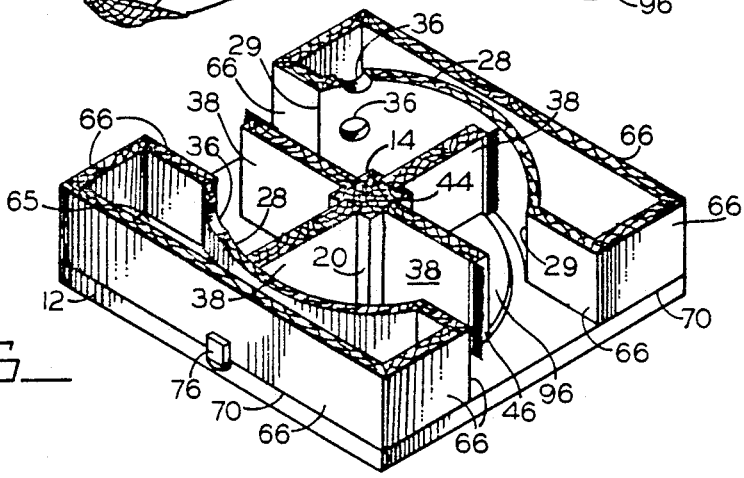

REVOLVING AIR LOCK

BACKGROUND OF THE INVENTION

1. Field Of The Invention

The present invention relates generally to air locks which are designed to allow workers to easily enter and exit a work area, the work area having either contamination which must be contained within the work area or being designated a clean area into which contaminated air must be prevented from entering.

2. Background of the Invention

Requirements for maintaining clean rooms or clean areas have been growing over the years as industry has had a need for maintaining clean manufacturing areas to ensure that parts remain uncontaminated during manufacture. In addition, there has been a great demand to provide means for containing contaminants, such as asbestos, within work areas and thereby prevent particles of the contaminants from escaping into the environment.

Air locks used in industry today usually consist of a relatively large square chamber, having doors on opposing ends for entrance and exit, between a clean and an unclean area. A person enters the chamber, closes the door, and an exhaust fan is turned on to remove the contaminated air that has been trapped within the chamber. The contaminated air is treated before being purged to the environment. One of the major drawbacks in the existing designs of these air locks, is that they are inefficient both in the time that it takes to purge the chamber and the effectiveness of the purging. The time required to open and close separate doors and to purge and treat a relatively large volume of air slows the movement of personnel. Relatively large rooms with four corners are difficult to purge as it is difficult to obtain air movement in the far corners. In addition, the chambers are bulky and difficult to relocate.

A common method for containing contaminants within a work area is to maintain the work area at a lower air pressure than the ambient air so that all air migration will be into the contaminated area and will thus prevent the escape of any contaminated particles entrained in the air. The lower pressure is maintained by removing air from the work area through high efficiency filters which treat the air prior to exhausting to the outside. This requires a measured amount of fresh air to be added to the controlled area as "makeup" air. The amount of makeup air must be regulated to ensure that neither too much nor too little is allowed to enter. This control of makeup air is often provided by allowing air to pass through polyethylene strip curtains that are installed at the entrances to the work area. The curtains remain partially open from the pull of the air passing through the curtains, making it extremely difficult to control the precise amount of air passing through. This results in either too little or too much air flow being permitted into the controlled area. If too much air flow is permitted to enter, the negative pressure is lost and contaminants may be permitted to escape to the environment. Contaminated areas are frequently separated from clean areas by erecting temporary stud walls covered with polyethylene sheeting. If too little air is allowed to enter to control the pressure differential, the polyethylene sheeting may become detached from the temporary walls due to the force of the pressure differential.

More complex structures having showers, baths, air screens, etc. have been employed, and in some cases may be necessary, but for most cases, a simpler and less expensive device will satisfy the control requirements.

SUMMARY OF THE INVENTION

In order to overcome the disadvantages of the prior art, the present invention is a small, easily assembled and disassembled portable air lock that may be easily entered and exited without the need for opening or closing doors and only necessitates the purging and filtering of a small volume of air. The air lock of the current invention may also be used in conjunction with shower facilities and changing rooms.

Most simply stated, the revolving air lock comprises a shaft, walls concentric to the shaft, a base, a bearing support means, a panel assembly and an air mover. The shaft has a generally vertical axis and a first and a second end, with the second end being rotatably connected to a base and the first end extending upwardly therefrom and being rotatably connected to a bearing support means. A pair of arcuate walls, each defining a segment of a single cylinder having an axis generally coaxial with the axis of the shaft are located concentric to and spaced apart from the shaft. At least one of the walls has at least one aperture therethrough. Each wall has a first and a second end, the first end of each wall being connected to the bearing support means and the second end of each wall being connected to the base, defining a generally cylindrical space between the bearing support means and the base of the air lock. The air lock panel assembly comprises a plurality of panels angularly spaced about the shaft, each panel having a radially inner edge and a radially outer edge, with the inner edge being attached to the shaft, such that the panels extend generally radially outwardly therefrom. A panel top edge engaging means, engages the top edges of the panels thereby defining a top end of the single cylinder which is closed thereby. The panels are so sized and configured that upon rotation of the shaft the outer edges of each pair of adjacent panels will be moved into a position adjacent the same arcuate wall. The pair of adjacent panels and that portion of the wall subtended by the adjacent panels define a chamber. The top of the chamber is closed by the top end and the bottom of the chamber is closed by a slidable engagement between the panel bottom edges and the base. An air mover is connected in fluid flow communication with at least one aperture through at least one of the arcuate walls, whereby air and air entrained particles may be removed from the chamber that includes that portion of the cylindrical wall containing an aperture. The arcuate wall segments are configured so that the vertical edges of the walls are spaced apart, creating two generally opposed open segments. These open segments are sized so that a person may enter through a first opening, rotate the shaft with its attached panels, and exit through the second opening.

The invention accordingly comprises an article of manufacture possessing the features, properties, and the relation of elements which have been exemplified in the article hereinafter described, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings, in which:

FIG. 2 is a fragmentary elevational view of connecting means for attaching panels to the shaft of the air lock of FIG. 1;

Figures 1, 1A:
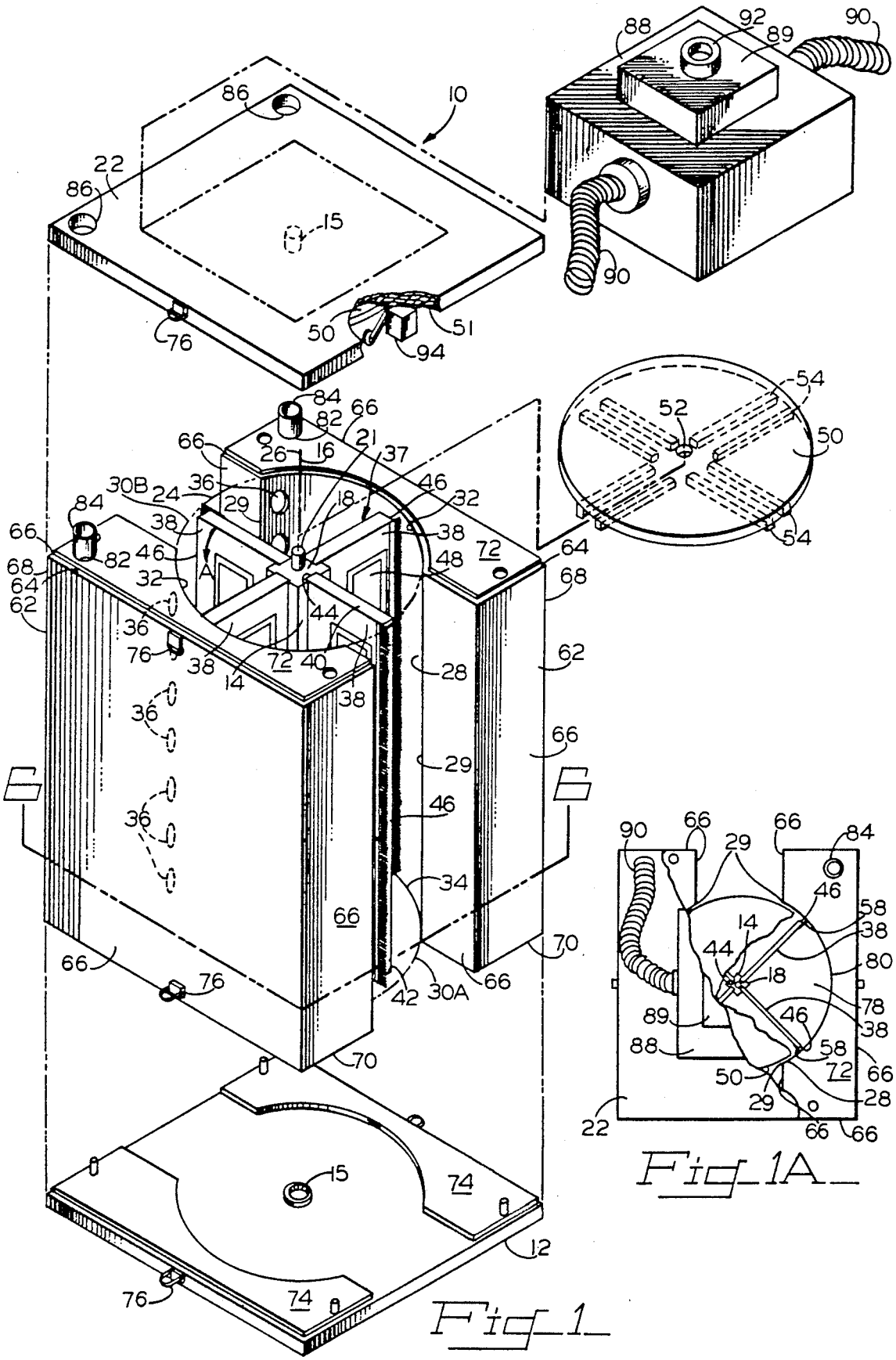
FIG. 1 is an exploded isometric view of a preferred embodiment of the revolving air lock.
FIG. 1A is a top view of the air lock of FIG. 1 with a portion of the lid broken away.

FIG. *2a* is a fragmentary plan view of structure for attaching panels to the shaft of the air lock of FIG. 1;

FIG. 3 is a fragmentary elevational view of the panel bottom edge sealing means of the air lock of FIG. 1;

FIG. 3A is a fragmentary elevational view of the panel top edge sealing means of the air lock of FIG. 1;

FIG. 4 is a fragmentary isometric view of a preferred embodiment for attaching a material tray to the panels of the air lock of FIG. 1;

FIG. 5 is a cross sectional view of the tray attaching means of FIG. 4, taken along line 5—5 of FIG. 4; and FIG. 6 is an isometric cross sectional view taken along lines 6—6 of the revolving air lock of FIG. 1

DETAILED DESCRIPTION

A preferred embodiment for the revolving air lock of this invention is illustrated in the drawing FIGS. 1-6. The revolving air lock is generally indicated as 10 in FIG. 1. Referring first to the view of FIGS. 1, 1A and 2, it can be seen that the revolving air lock comprises a base 12, a shaft 14 having a generally vertical axis 16, a first end 18 and a second end 20, and a lid 22. The second end 20 of the shaft 14 is rotatably connected to the base 12 and extends upwardly therefrom where it is rotatably connected to the lid 22. A single cylinder 24 with a generally vertical axis 26 may be defined such that the cylinder's axis 26 is generally coaxial with the axis 16 of the shaft 14. At least two arcuate walls 28 each define a segment of cylinder 24 such that the walls 28 are located concentric to and spaced apart from the shaft 14. The walls 28 are so configured that the adjacent vertical edges 29 of the walls are spaced apart, defining two open segments 30A and 30B of the cylinder 24, as shown in FIGS. 1 and IA. The open segments 30A and 30B provide means for entering and exiting the air lock 10. Each wall 28 has a first end 32 and a second end 34, with the first end 32 being removably connected to the lid 22 and the second end 34 being removably connected to the base 12.

The revolving air lock is placed to join two separated areas (not shown) whereby entering one side, for example 30A, and leaving the opposing side 30B, will permit a person or material to pass between these separated areas. Opening 30A is aligned toward the contaminated or dirty side, while 30B opens to the clean side. At least one aperture 36 extends through walls 28 and preferably comprises, without limitation, a series of six two-inch diameter apertures located in each wall 28 adjacent to the vertical edges 29 that are adjacent the opening 30B. The apertures 36 may be fewer in number, oval, rectangular or other shape, larger or smaller, or of any other suitable configuration.

The air lock of FIG. 1 includes a panel assembly, shown generally as 37, comprising four panels 38, each having a top edge 40, a bottom edge 42, a radially inner edge 44 and a radially outer edge 46. The radially inner edge 44 is removably attached to the shaft 14. As shown in FIGS. 2 and 2A, the shaft 14 in the preferred embodiment has a generally rectangular cross section at right angles to the shaft's vertical axis 16, with a cylindrical portion 21 contiguous with the first end 18 and the second end 20 of the shaft 14. The cylindrical portions 21 are mounted in conventional bearings 15 such that the shaft 14 with the panels 38 mounted thereon may rotate. In the preferred embodiment the shaft rotates only in the standard counter clockwise direction when viewed from above (see arrow A); however, the air lock may be adjusted so that the shaft operates in the clockwise direction, if desired. The shaft 14 may be a cylindrical shaft on which is mounted a fastening means for the panels 38, or of any similar construction well known in the industry. In the preferred embodiment four panels 38 are shown; however, depending upon the size of the revolving air lock three or more panels 38 may be used. Each panel 38 preferably has a transparent section 48 for viewing purposes.

The panel top engaging means in the preferred embodiment comprises a panel support 50, which is provided to help maintain the predetermined spatial relationships between the panels 38. The panel support 50 also defines a top end to the single cylinder 24. The panel support 50 has a hole 52 passing through the center point of the support panel 50, which is so sized that the hole 52 through the panel support 50 may receive the cylindrical portion 21 of the shaft 14. Pairs of panel support blocks 54 are so spaced apart that they may be placed on either side of the top edge 40 of each panel 38, thus providing proper alignment and support to each panel 38. In another embodiment the support panel may be eliminated. The panel top engaging means is then provided by the slidable engagement of each top edge 40 of each panel 38 with the interior surface 51 of the lid 22, which then defines the top end to cylinder 24.

As shown in FIG. 3, a first sealing means 56 is attached to the bottom edge 42 of each panel and a second sealing means 58 is attached to the outer edge 46 of each panel such that the bottom edge 42 is slidably sealed with the base 12 and the outer edge 46 may be slidably sealed with one of the walls 28 as the shaft 14 and the panels 38 are rotated. If, in another embodiment, the panel supports 50 were not provided, a third sealing means 60 as shown in FIG. 3A, would be provided to slidably seal the top edge 40 to the lid 22. The first sealing means 56 and third sealing means 60 may preferably comprise, without limitation, a u-shaped rubber seal; however, flap rubber seals, felt, or any similar construction may be used as well. The second sealing means 58 may preferably comprise, without limitation, a brush-type seal; however, flap seals, felt seals or any similar construction may be used as well.

FIG. 1 shows two plenums 62, each comprising a six-sided, hollow, enclosed body with a top 64 and bottom 65 (shown in FIG. 6), with one side comprising the wall 28 and the remaining sides, which may be of any convenient configuration, identified as 66. Each plenum top 64 may include a gasket 72 sealingly interposed between the plenum top 64 and the lid 22. Each plenum bottom 65 may include a gasket 74 sealingly interposed between the plenum bottom 65 and the base 12. In another embodiment, the plenums 62 may have one or more open ends, which would then be sealingly closed at the first end 68 by gasket 72 and lid 22, and sealingly closed at the second end 70 by gasket 74 and base 12. The lid 22 is attached to each plenum 62 by a quick release connector 72 which extends between each plenum 62 and the lid 22. The base 12 is attached to each plenum 62 by a quick release connector 76. In other embodiments the plenums 62 may range in size from an enclosure just covering the apertures to the full sized plenums 62 disclosed in the preferred embodiment. The smaller plenums would contain any feasible number of sides as long as one side contained a portion of the arcuate wall 28 which contains the apertures 36. In this configuration the lid 22 preferably would be s configured and the gasket 72 preferably would be so configured that the lid 22 would be sealed directly to the walls 28. The same would hold true for the connection between the walls and the base, that is, the base 12 and the related gaskets 74 would be so configured that the base 12 could be attached and sealed to the walls 28.

With the air lock 10 assembled as shown in FIG. 1A, and upon rotation of the shaft 14, the radially outer edges 46 of a pair of adjacent panels 38 will be moved into a position adjacent the same wall 28, defining a closed chamber 78 as shown in FIG. 1A. The pair of adjacent panels 38 and the portion 80 of the wall 28 subtended by the adjacent pair of panels 38 define the walls of the chamber 78. The top of the chamber 78 is closed by the top end, defined by the panel support 50. The bottom of the chamber 78 is closed by the slidable engagement between the panel bottom edges 42 of the adjacent panels 38 and the base 2.

In the preferred embodiment each plenum has an orifice 82 through each plenum top 64 of each plenum 62. To each orifice 82 is attached a short pipe 84 which projects through a hole 86 in lid 22. An air mover 88, which may conveniently be a fan or blower or the like, having a filter means 89 connected thereto, is placed on the lid 22. An air distribution means, comprising the hoses 90, is then attached to the respective pipes 84 as well as to air mover 88. While this is the preferred embodiment, the orifices may project through any side of the plenums with the exception of the wall 28. In addition, there may be more than one air mover 88 and a plurality of orifices 82. The filter means 89, which may comprise a conventional filter assembly, is located so that any air removed from the chambers must pass through the filter before leaving the air outlet 92.

In the preferred embodiment a switch 94 may be located so that, upon rotation of the axle 14 and the panel support 50, the switch 94 would turn on the air mover 88.

FIG. 6 illustrates the use of an equipment tray 96, which may be attached as shown in FIG. 4 to two adjacent panels 38. Conventional male and female attaching clips 98 and 99, respectively, are shown in FIG. 4 and in cross section in FIG. 5.

The panels 38 are easily attached to the shaft 14 by quick release connectors 100 as illustrated in FIG. 2 and FIG. 2A. Any similar quick release systems well known in the industry may be used. A different style of quick release connectors 76 is shown in FIGS. 1 and 6 attaching the base to the plenum and the lid to the plenum.

The walls, base, top, lid, panels and shaft of the revolving air lock 10 in the preferred embodiment may preferably, without limitation, be constructed of wood that has been covered with fiberglass. Any suitable material or combination of materials may be used with satisfactory results, including metals, plastics and the like.

Having thus set forth a preferred construction for the revolving air lock 10 of this invention, it is to be remembered that this is but a preferred embodiment. Attention is now invited to a description of the use of the revolving air lock 10. The revolving air lock 10 may be used in many different situations, a typical one being described as follows. A work area containing contaminated materials, for example asbestos, has been sealed off from the remainder of the building by a temporary wall comprised of stud walls covered with a polyethylene material. The revolving air lock is assembled within an opening between the two areas. The base is placed so that the opening 30A opens to the contaminated side and opening 30B opens to the clean side of the work area. The cylindrical portion 21 of the second end 20 of the shaft 14 as shown in FIG. 2, is rotatably inserted into the bearing 15 of base 12. After the panels 38 are attached to the shaft 14, the panel support 50 is received on the cylindrical portion 21 of the first end 18 of the shaft 14 so that the panels 38 are held firmly in position. Gaskets 74 are placed upon the base 12 and the plenums 62 are attached to the base 12 by quick release fasteners 76. The gaskets 72 are then placed on each plenum top 64 of each plenum 62 and the lid 22 is mounted so that the pipes 84 pass through the holes 86 in the lid 22. At the same time the first end 18 of the shaft 14 is rotatably connected to the lid 22 by mounting the cylindrical portion 21 of first end 18 of the shaft 14 into the bearing 15 attached to lid 22. The air mover 88 with its filter system 89 is then placed upon the lid 22, and the hoses 90 are connected to the respective pipes 84.

With the revolving air lock 10 now assembled, a person may enter the air lock 10 and rotate the panels 38 in a counterclockwise fashion. When the chamber 78 in which the person is moving passes by the apertures 36, the air and entrained contaminants will be removed from the chamber 78 by the air mover 88. The suction of the air mover 88 will pull the air and contaminants through the apertures and into the plenum 62, out the plenum 62 through the orifice 82, out the pipes 84, through the hoses 90, through the filters 89 and then out the exhaust 92. The filters used in the preferred embodiment are high efficiency particulate absolute filters; however, any suitable filter may be selected and used for the particular type of contamination that must be captured. A person may now step through the exit/entrance 30B into the clean area. As the air mover 88 continues to operate, the contaminated air trapped within the chamber 78 will continue to be removed from the chamber even though the chamber seal has been broken by the lead panel, of the pair of panels, passing into the open area 30B. Clean air will then also be drawn into the open chamber 78 which prevents most remaining entrained contaminants from moving into the clean area. Person. may now enter the contaminated area by entering an open chamber 78, revolving the panels 38 until the chamber 78 opens onto the opening 30A which leads to the contaminated area. If an equipment tray 96 is installed between a pair of adjacent panels 38, it becomes unnecessary for persons to travel between the contaminated and the clean areas. The equipment may be simply placed upon the tray 96, the doors manually revolved until the tray is exposed on the opposite side and the equipment removed. Upon completion of the use of the revolving air lock 10 it may be rapidly disassembled and relocated to a new work site.

It will thus be seen that the object set forth above, among those made apparent from the preceding description, are efficiently attained and, since certain changes may be made in the above article without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, what is claimed is:

1. A revolving air lock for controlling the flow of air, and the passage of contaminants that may be entrained in the air, between two separate areas, comprising:

a base;

a shaft having a generally vertical axis, and having a first end and a second end, said second end rotatably connected to said base, with said shaft extending upwardly therefrom, and being rotatable about said axis;

bearing support means rotatably connected to said first end of said shaft;

at least two arcuate walls, each defining a segment of a single cylinder having an axis generally coaxial with said axis of said shaft, said walls located generally concentric to and spaced apart from said shaft, said walls being so configured as to define at least two open segments of said cylinder, such that entrance and exit to said air lock may be obtained therethrough, each said wall having a first end and a second end, said first end of each said wall connected to said bearing support means and said second end of each said wall connected to said base with at least one of said walls having at least one aperture therethrough;

a panel assembly comprising a plurality of panels, each said panel having a top edge, a bottom edge, a radially inner edge and a radially outer edge, said inner edge of each said panel being connected to said shaft such that each said panel extends generally radially outwardly therefrom, and panel top edge engaging means for engaging said top edges of said panels to define a top end of said single cylinder, whereby said top end of said single cylinder is closed, said panel assembly being so sized and configured that, upon rotation of said shaft said radially outer edges of each pair of adjacent said panels will be moved into a position adjacent to one said wall, said pair of adjacent said panels and that portion of said wall subtended by said adjacent panels defining a chamber, said top of said chamber being closed by said top end and said bottom of said chamber being closed by a slidable engagement between said panel bottom edges and said base; and an air mover connected in air flow communication to said aperture in said wall, whereby said air and any said contaminants entrained therewith may be removed from said chamber that includes that portion of said wall containing said aperture.

2. A revolving air lock as in claim 1 wherein said panel top edge engaging means comprises a panel support attached to said shaft and to said top edge of each of said panels such that said panels are retained in a predetermined spatial relationship with one another, whereby said support means comprises said top cylinder end.

3. A revolving air lock as in claim 2 further comprising first sealing means attached to said bottom edge of each said panel; and second sealing means attached to said outer edge of each said panel, such that said bottom edge is slidably sealed with said base, and said outer edge is slidably sealed with said wall.

4. A revolving air lock as in claim 1 wherein said bearing support means comprises a lid, having said bearing mounted thereto, said lid being attached to said walls.

5. A revolving air lock as in claim 4 further comprising a top gasket sealingly interposed between said first end of each said wall and said lid; and a bottom gasket sealingly interposed between said second end of each said wall and said base.

6. A revolving air lock as in claim 4 wherein said lid further comprises an interior surface providing said panel top edge engaging means, whereby said lid comprises said top end of said single cylinder.

7. A revolving air lock as in claim 6 further comprising first sealing means attached to said bottom edge of each said panel;

second sealing means attached to said outer edge of each said panel; and third sealing means attached to said top edge of each said panel, such that said bottom edge is slidably sealed with said base, said outer edge is slidably sealed with said wall, and said top edge is slidably sealed with said lid.

8. A revolving air lock as in claim 4 further comprising at least one plenum having a plurality of sides, one said side defined by at least a portion of said wall containing at least one aperture, said plenum having at least one orifice therethrough, and said aperture and said orifice both connected in air flow communication to said air mover.

9. A revolving air lock as in claim 8 further comprising a first plenum and a second plenum wherein said first arcuate wall, a portion of said lid and a portion of said base comprise three of said sides of said first plenum, and said second arcuate wall, a portion of said lid and a portion of said base comprise three of said sides of said second plenum.

10. A revolving air lock as in claim 9 wherein said lid, base, plenums, shaft and panels are joined to one another by quick release connectors extending between said panels and said shaft, between said base and said plenums and between said top and said plenums, such that said revolving air lock may be easily disassembled for transport.

11. A revolving air lock as in claim 1 further comprising air distribution means and filter means connected in air flow communication between said air mover and said wall aperture, such that air within each said chamber adjacent to said aperture may be removed therefrom and passed through said distribution means and said filter means, whereby a portion of any contaminants entrained in the air may be removed from the air.

12. A revolving air lock as in claim 1 further comprising at least one plenum, said plenum having a plurality of sides, wherein one said side of said plenum comprises at least a portion of said wall having said aperture therethrough, said plenum having at least one orifice through one of said sides of said plenum other than said wall portion thereof, and said aperture and said orifice both connected in air flow communication to said air mover.

13. A revolving air lock as in claim 1 further comprising at least one equipment tray removably mounted within a said chamber.

14. A revolving air lock as in claim 13 wherein said equipment tray is removably mounted to a pair of adjacent said panels comprising said chamber.

15. A revolving air lock as in claim 1 wherein four panels are mounted to said shaft substantially normal to one another.

16. A revolving air lock as in claim 1 further comprising means for activating said air mover upon rotation of said shaft.

17. A revolving air lock as in claim 1 wherein said panels are removably attached to said shaft.

18. A revolving air lock for controlling the flow of air, and the passage of contaminants that may be entrained in the air, between two separate areas, comprising a base;

a shaft having a generally vertical axis, and having a first end and a second end, said second end rotatably connected to said base, with said shaft extending upwardly therefrom, and being rotatable around said axis;

a lid to which said first end of said shaft is rotatably connected;

at least two arcuate walls, each defining a segment of a single cylinder having an axis generally coaxial with said axis of said shaft, said walls located generally concentric to and spaced apart from said shaft, said walls being so configured as to define at least two open segments of said cylinder, such that entrance and exit to said air lock may be obtained therethrough, each said wall having a first end and a second end, said first end of each said wall connected to said lid and said second end of each said wall connected to said base with at least one of said walls having at least one aperture therethrough;

a panel assembly comprising a plurality of panels, each said panel having a top edge, a bottom edge, a radially inner edge and a radially outer edge, said inner edge of each said panel being connected to said shaft such that each said panel extends generally radially outwardly therefrom;

a panel support comprising a plate attached to said shaft and engaging said top edges of said panels such that said panels are retained in a predetermined spatial relationship with one another, said panel support defining a top end of said single cylinder, whereby said top end of said single cylinder is closed, said panel assembly being so sized and configured that upon rotation of said shaft said radially outer edges of each pair of adjacent said panels will be moved into a position adjacent to one said wall said pair of adjacent said panels and that portion of said wall subtended by said adjacent panels defining a chamber, said top of said chamber being closed by said to end and said bottom of said chamber being closed by slidable engagement between said panel bottom edges and said base;

first sealing means attached to said bottom edge of each panel such that said bottom edge is slidably sealed with said base;

second sealing means attached to said outer edge such that said outer edge is slidably sealed with said wall; and a first plenum and a second plenum, each said plenum comprising a hollow enclosed body having a plurality of sides, said lid forming said top side of each said plenum, said base being joined to said hollow enclosed body sides and forming said bottom side of each said plenum, and one of said walls having said aperture therethrough comprising one said side of a respective said plenum, each said plenum having at least one orifice therethrough;

an air distribution means connected in air flow communication to each said orifice;

an air mover connected in air flow communication to said air distribution means, whereby said air and said contaminants entrained therewith may be removed from said chamber that includes that portion of said wall containing said aperture; and filter means connected in air flow communication with said air mover, such that said contaminants entrained therewith, may be removed from said air.

* * * * *

UNITED STATES PATENT AND TRADEMARK OFFICE

CERTIFICATE OF CORRECTION

PATENT NO. : 5,042,367

DATED : AUGUST 27, 1991

INVENTOR(S) : DWIGHT HOPKINS

It is certified that error appears in the above-identified patent and that said Letters Patent is hereby corrected as shown below:

In the claims, column 10, line 13, insert a comma "," after the word "wall" and on line 16, delete the word "to" and insert therefor --top--.

Signed and Sealed this

Sixth Day of October, 1992

*Attest:*

*Attesting Officer*

DOUGLAS B. COMER

*Acting Commissioner of Patents and Trademarks*